US008851699B2

(12) United States Patent
McMillan

(10) Patent No.: US 8,851,699 B2
(45) Date of Patent: Oct. 7, 2014

(54) MULTI-LEVEL THERMAL AIR COOLED LED LIGHT FIXTURE

(75) Inventor: George Erik McMillan, Hickory, NC (US)

(73) Assignee: Enigma Universal Technologies, LLC, Newton, NC (US)

( * ) Notice: Subject to any disclaimer, the term of this patent is extended or adjusted under 35 U.S.C. 154(b) by 284 days.

(21) Appl. No.: 13/343,454

(22) Filed: Jan. 4, 2012

(65) Prior Publication Data

US 2012/0170255 A1 Jul. 5, 2012

Related U.S. Application Data

(60) Provisional application No. 61/429,986, filed on Jan. 5, 2011.

(51) Int. Cl.

| | |
|---|---|
| ***F21S 8/00*** | (2006.01) |
| ***F21S 8/04*** | (2006.01) |
| ***F21V 21/04*** | (2006.01) |
| ***F21S 8/02*** | (2006.01) |
| ***F21V 29/00*** | (2006.01) |
| *F21Y 101/02* | (2006.01) |

(52) U.S. Cl.

CPC ..... *F21S 8/04* (2013.01); *F21V 21/048* (2013.01); *F21Y 2101/02* (2013.01); *F21S 8/026* (2013.01); *F21V 29/26* (2013.01); *F21V 29/004* (2013.01); *F21V 29/2231* (2013.01); *Y10S 362/80* (2013.01)

USPC ..... 362/149; 362/150; 362/249.02; 362/294; 362/373; 362/404; 362/800

(58) Field of Classification Search

USPC ..... 362/147–150, 249.02, 294, 364–365, 362/404, 800

See application file for complete search history.

(56) References Cited

U.S. PATENT DOCUMENTS

2011/0267829 A1* 11/2011 Horng et al. ..... 362/373

* cited by examiner

*Primary Examiner* — Jason Moon Han

(74) *Attorney, Agent, or Firm* — Nifong, Kiefer and Klinck, PLLC

(57) ABSTRACT

There is provided a lighting fixture adapted to be installed on a ceiling having a predetermined plane. A light emitting diode light source is supported by the lighting fixture. At least a portion of the lighting fixture protrudes below the plane of the ceiling supported by the lighting fixture. A heat sink is attached to the back side of the LED light source. The heat sink includes a thermal chimney directing heat away from the LED light source.

11 Claims, 4 Drawing Sheets

MULTI-LEVEL THERMAL AIR COOLED LED LIGHT FIXTURE

RELATED APPLICATION

This is a U.S. non-provisional application relating to and claiming the benefit of U.S. Provisional Patent Application Ser. No. 61/429,986 filed Jan. 5, 2011.

BACKGROUND OF THE INVENTION

For years, since the arrival of the drop-ceiling, Troffer drop-in fixtures have been used to light areas covered by such ceilings along with can lights and a few standard light fixture conversions. As the recessed drop-in Troffers go, (the 1'×4', the 2'×4' and the 2'×2'), they have all been nearly the same in regard to aesthetics. All have been designed with the light emitters or bulbs within the fixture located above the ceiling plane with a cover lens the same size as the light opening or have a simple grid within the opening, neither having much architectural design or artistic value. There are several issues with these fixtures, whether they are T8 or T5 fluorescents or even LED retrofit kits or LED replacement fixtures. Since the light source is above the ceiling plane, it does not spread the light evenly from wall bottom to wall top. In addition, recessed drop-in Troffers do not address the issue of heat build-up within the fixture.

In the realm of thermal management of small electric components, such as computer modules, chips, PC components and LED heat dissipation needs, there exists a variety of convection type and fan controlled heat sinks. Within this same arena, there is also a rising array of liquid cooled thermal management systems designed to remove unwanted, detrimental heat. There are basically three main types of cooling systems with variations of each. First and most prevalent are the simple convection heat sinks made primarily of aluminum or copper which allow heat to transfer from the component into the heat sink and then convect into the surrounding air. Second, and more effective, is combining the heat sink with a fan to accelerate the convection process. Third, and very effective though usually much bulkier, is the liquid cooled thermal transfer method consisting of a heat sink with embedded tubing containing a coolant or a radiator and a fan to cool the fluid or vapor. All three systems have their pros and cons.

A simple heat sink has the following pros: inexpensive and easy to manipulate size and shape to fit an area; no electrical devices such as fans that add cost and pose possible failure issues; and silent in operation. A simple heat sink has the following cons: convection is slow in comparison with moving air systems; and convection is very limited in the ability to efficiently remove heat, thus, is only useable in small or mild heat applications.

A combined fan and heat sink has the following pros: moving air is far more effective in forcing convection, speeding up heat thermal elimination; and fans are not very expensive and have a fairly long lifespan. A combined fan and heat sink has the following cons: fans increase the size and add to labor and time as they are an electric component; failure of the fan can cause overheating and damage to the component it is used to cool; fans produce noise; and fans consume energy.

Liquid cooling systems have the following pros: very effective in removing heat; able to cool larger more difficult components; and price is becoming more affordable. Liquid cooling systems have the following cons: currently, still relatively expensive; most efficient liquid coolers are much larger than alternate systems limiting their usage; due to the necessity of the fan to cool the liquid or vapor, failure is a possibility which will cause serious damage to the component it is to cool; the fan aspect produces noise; and the fan aspect consumes energy.

The use of Peltier Plates is another method of cooling components. The Peltier Plates method is, however, expensive and uses a fair amount of energy just to generate a cooling effect on one side while, at the same time, it builds heat on the other side that can cause a very hot surrounding especially if an additional fan is not used. This actually creates two possible points of failure: failure of the Peltier Plate itself or failure of the cooling fan, wherein either failure would, in most applications, cause damage to the component it is used to cool.

What is needed is a thermal system that has the advantages of the cheaper convection heat sink and yet has the effectiveness of a fan or liquid cooling system by accelerating the convection cycle while eliminating the cons associated with the fan-based cooling systems. It is an object of the present invention to provide a cooling system that moves air without the addition of extra electrical devices.

In accordance with one form of this invention, there is provided a lighting fixture adapted to be installed on a ceiling having a predetermined plane. A light emitting diode source is supported by the lighting fixture. At least a portion of the lighting fixture protrudes below the plane of the ceiling.

In accordance with another form of this invention, there is provided a lighting fixture which includes a light emitting diode light source. The light emitting diode light source has a front side which emits light and a back side opposite the front side. A primary heat sink is attached to the back side of the light emitting diode light source. Preferably, a divider plate is used to create two separate planes. A thermally conductive material is recommended for the divider plate, such as aluminum, copper or other such material allowing greater thermal surface for heat transfer. A pass-through or cross-over vent or vents are preferably used to allow air to pass from the lower plane to the upper plane via said heat sink, mounted below the divider plate. Preferably, a void is incorporated in the heat sink's center and this void is situated directly in line and under one of the divider plate vent openings, allowing heated air to pass from the lower plane to the upper plane. To be more efficient, a secondary heat sink is preferably mounted directly above the primary heat sink via the divider plate and directly above the vent pass-through. The primary heat sink center void may remain hollow or created with thermal posts, rings or a cone, depending upon the LED or LED array used to develop the most effective thermal transfer method for the desired LED/LED array. This dual plane development for heat transfer creates a thermal chimney or "air thermal pump" which, due to the physics of moving heat or heated air upward through the cross-over vent, creates a partial vacuum in the lower plane and primary heat sink which, in turn, draws cool air into said lower plane. This system thus accelerates the thermal exchange and increases the cooling capabilities of the heat sink.

BRIEF DESCRIPTION OF THE DRAWINGS

The subject matter which is regarded as the invention is set forth in the independent claims. The invention, however, may be better understood in reference to the accompanying drawings in which:

DESCRIPTION OF THE PREFERRED EMBODIMENTS

Figure 1:
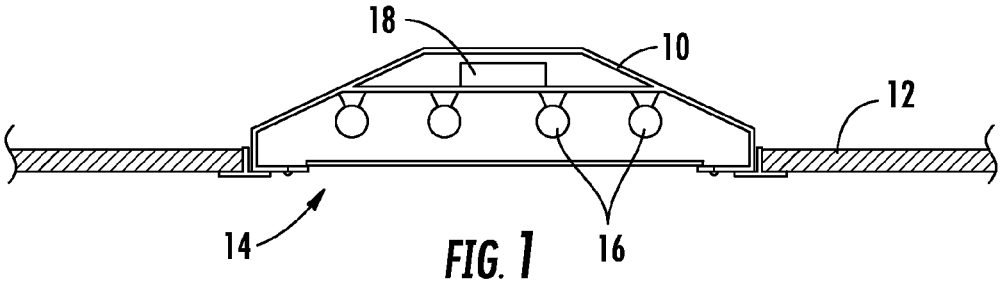
FIG. 1 PRIOR ART
FIG. 1 is an end view of a prior art ceiling mounted lighting fixture.

FIG. 1 shows a standard prior art fluorescent fixture 10 mounted to ceiling 12 within opening 14 in ceiling 12. Fixture 10 includes a plurality of fluorescent tubes 16. Ballast 18 is provided within fixture 10 to control fluorescent tubes 16. As can be seen, the entire fixture 10, including fluorescent tubes 16, is mounted above the plane of ceiling 12. Thus, light does not spread evenly from top to bottom of the walls within the room, nor does light impinge upon the ceiling. In addition, the standard fluorescent fixture is rather unattractive.

Applicant's designs illustrated in FIGS. 2-10, solve the problem of the lack of even light dispersion from floor to ceiling as well as the lack of aesthetics associated with prior art fixtures. Applicant has created an entirely new alternative to standard, every day, run-of-the-mill recessed drop-in Troffers-type fixtures. Applicant has developed a three dimensional multi-plate multi-lens drop-in fixture built for various panel openings, including one foot by four foot, two foot by four foot, and two foot by two foot openings. At least a portion of Applicant's fixtures protrude below the plane of the ceiling, thus allowing for a very uniform and evenly dispersed light output.

Figure 2:
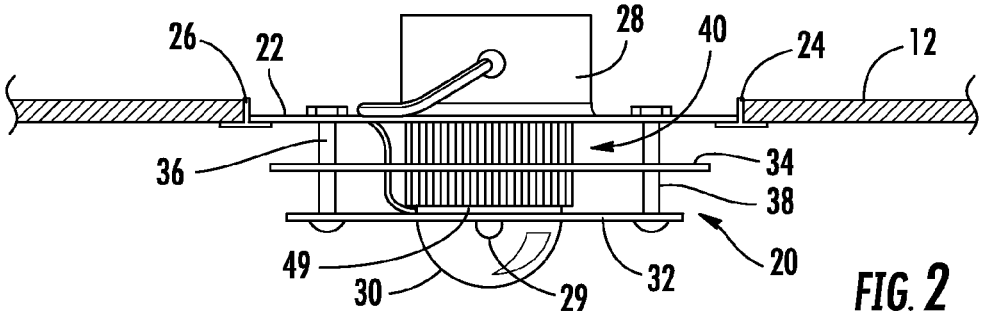
FIG. 2 is an end view of an LED lighting fixture showing one embodiment of the invention.
Figure 8:
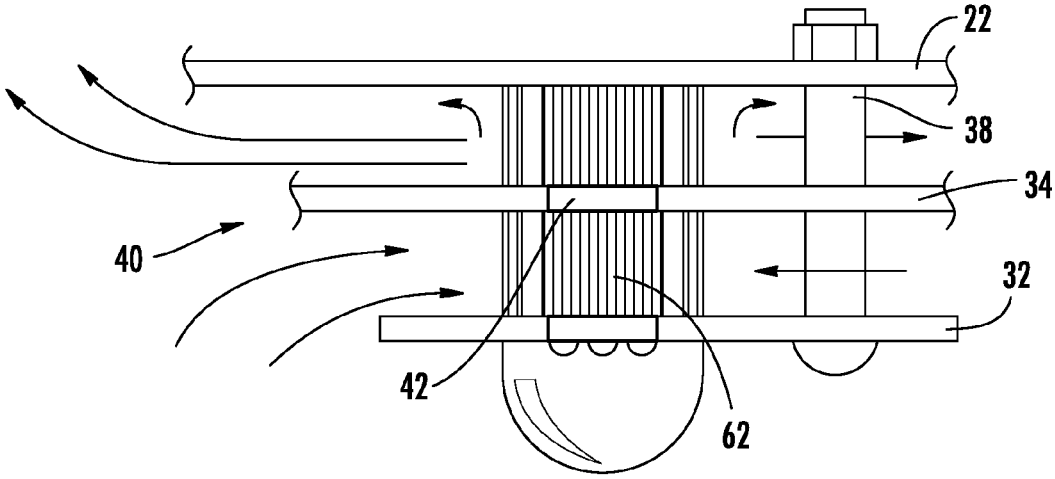
FIG. 8 is a more detailed end view of a portion of the embodiment of FIG. 1.

Referring now more particularly to FIG. 2, Applicant provides a multi-level LED light fixture 20 having mounting plate 22 which is attached to ceiling 12 by the drop-ceiling cross members 24 and 26. Mounting plate 22 provides support for fixture 20 and further operates as a secondary thermal dissipater. AC to DC power supply 28 is mounted on top of mounting plate 22. AC to DC power supply is electrically connected to LEDs 29 which are attached to a circuit board which is received within or adjacent to dome lens 30. Dome lens 30 are attached to lens plate 32. A thermal plate 34 is located between mounting plate 22 and lens plate 32. The base plate, lens mounting plate and thermal plate are spaced apart and are held in place by spacers 36 and 38. Heat sink 40 combined with a divider or thermal plate 34, also referred to as thermal pump component cooler, is located between mounting plate 22 and lens plate 32 and is adjacent and aligned to opening, or vent hole 42 in thermal plate 34, as best illustrated in FIG. 8. As will be described below in more detail, thermal pump component cooler thermal plate 34 acts as a thermal separator while the opening 42, in the plate 34 allows heat to pass through, from the lower plane to the upper plane, creating a void in the air space of the lower heat sink 62, due to the heated air moving upward and away from the lower plane via the vent hole 42. As the heat is transferred from the lower heat sink 62, cool air is drawn into the void thus, accelerating the thermal exchange cycle. Since the LEDs 29 are in contact with the lower portion of the thermal pump component cooler, the LEDs 29 are effectively thermally connected to thermal plate 34.

Lens plate 32 is preferably not a thermal conductor. Preferably, lens plate 32 is constructed of material, such as plexiglas, Lexan, acrylic or polycarbonate. Openings are provided in the lens plate 32 which incorporate domed or flat or optic lenses, but may be left open for light to pass unobstructed. In the embodiment where the lens plate is made of an acrylic resin or other clear or semi-clear material, it is preferred that the material be modified to be translucent so as to help evenly spread the light while hiding the components behind the lens plate 32. However, it is not required that the lens plate 32 be translucent and it may be transparent if desired.

As can be seen, domed lens 30 is located below the plane of ceiling 12. This location of the domed lens 30 and the LED lights 29 received therein will help create a uniform evenly spread light within the area to be illuminated, including light on the ceiling 12 and the walls of the room from top to bottom.

Figure 3:
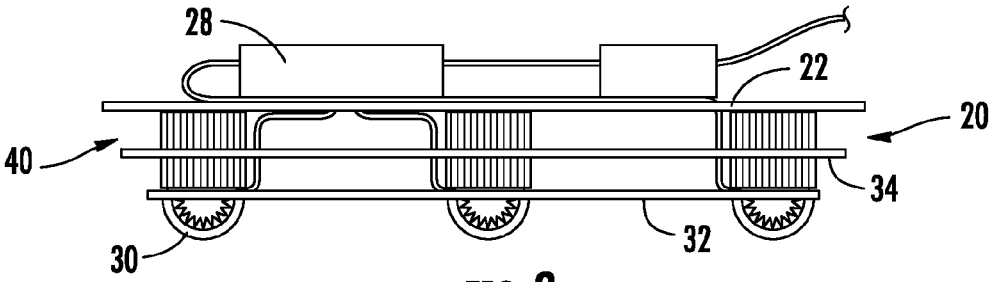
FIG. 3 is a side view of the embodiment of FIG. 2.
Figure 4:
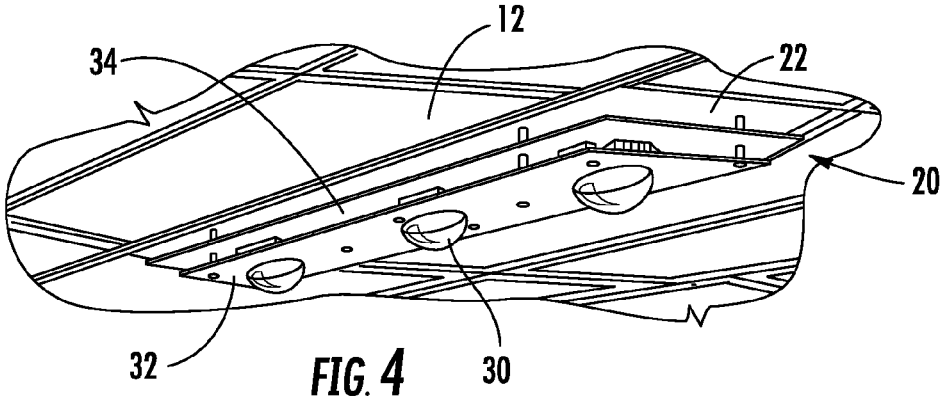
FIG. 4 is a perspective view of the embodiment of FIG. 2.

As can be seen in FIGS. 2-4, in one embodiment of the invention there are three lighting units associated with fixture 20.

Figure 5:
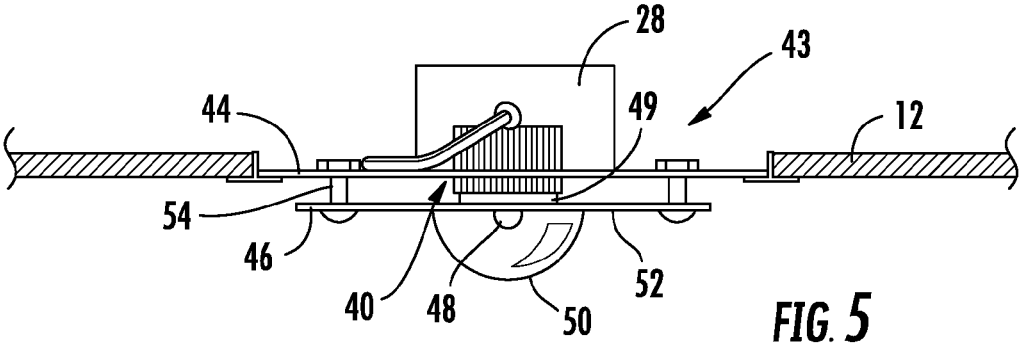
FIG. 5 is an end view showing an alternative embodiment of the invention.
Figure 6:
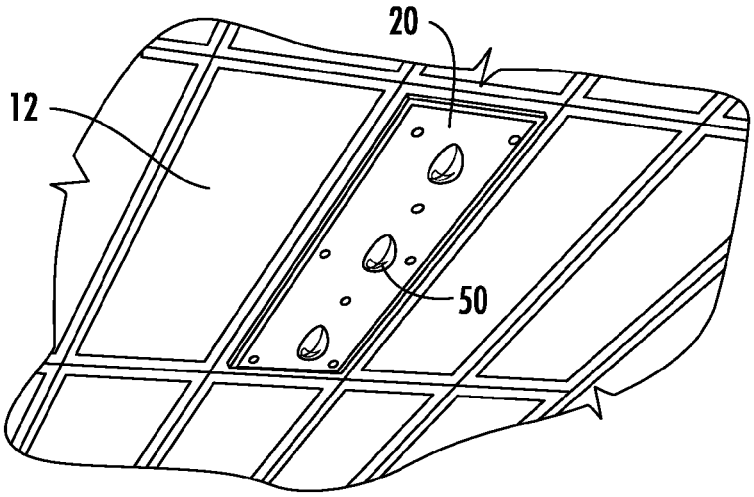
FIG. 6 is a perspective view of the embodiment of FIG. 5.
Figure 7:
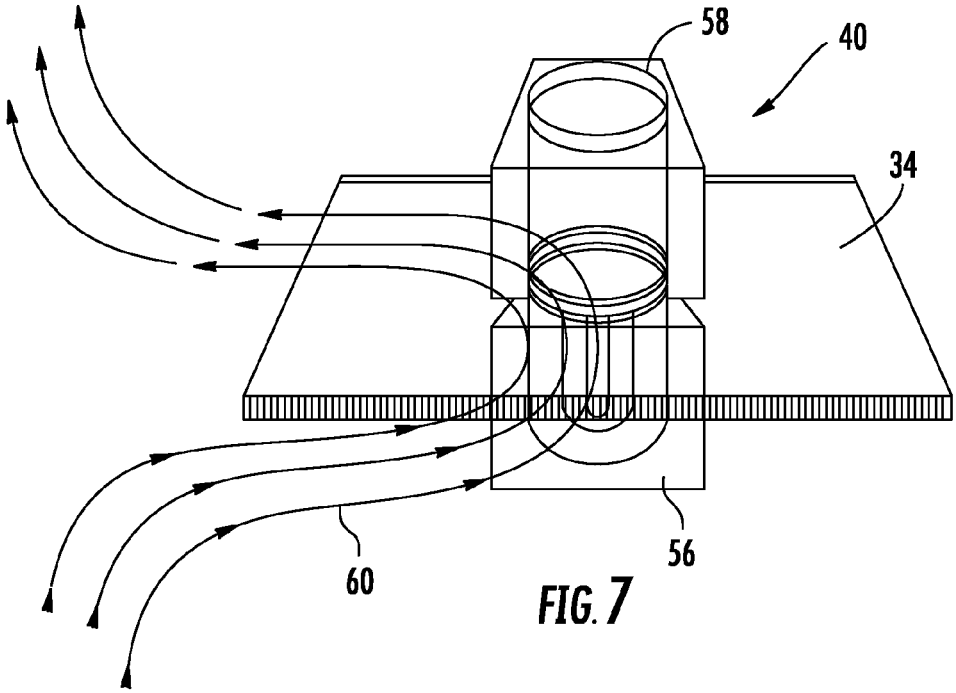
FIG. 7 is a perspective view of a schematic illustration of the thermal heat sink aspect of the invention.

Referring now more particularly to FIGS. 5 and 6, there is provided a two plate lighting fixture 43, including thermal plate 44 which also serves as a mounting plate and lens plate 46. The mounting plate/thermal plate 44 is the size of an opening in ceiling 12. The mounting plate/thermal plate 44 is utilized as the primary thermal mounting plate as well as the thermal pump divider. The power supply 28 is mounted on top of mounting plate/thermal plate 44 and is electrically connected to LEDs 48 which are situated closely behind the dome lens 50. The dome lens 50 is mounted to lens plate 52. Thermal pump component cooler 40 is thermally connected with LEDs 48 and is connected to an opening in mounting plate/thermal plate 44. Spacers 54 maintain separation between mounting plate/thermal plate 44 and lens plate 52. Lens plate 52 can be made of several materials including plexiglas, Lexan, acrylic or polycarbonate. If a solid, non-light transmitting material is used such as fiberglass, openings are preferred at any light emitting zone and it is advisable to incorporate dome, flat, optic or other lenses in the openings. If a transparent or translucent lens plate is used, domed, flat or optic lenses can be utilized to direct the light output. However, it is not required to have lenses. In the embodiment of FIGS. 5 and 6, once again the lens 52 and LEDs 48 are located below the plane of ceiling 12 so that light is evenly and uniformly dispersed over the lighted area, including the ceiling and side walls.

In one aspect of the invention, there is provided multi-level plates forming a 3D architecture using two or three levels. This fixture is primarily designed for LED light applications and the upper level plate or plates are utilized as the mounting plate and can also be utilized as a thermal dispenser. When combined with the cooling system referred to below, the fixture becomes a highly efficient ultra-bright replacement or option versus fluorescent drop-in fixtures and LED retrofit and replacement kits.

In another aspect of the invention, there is provided a thermal air pump component cooling system to address the cooling issues in an LED lighting fixture. This cooling system allows a heat sink to be of minimal size and will out perform a standard convection heat sink. This further allows for far more applications at smaller scale and still allows excellent thermal dissipation. Applicant's heat sink takes advantage of the physical law that heat rises and that if a substance such as a gas, vapor, air or liquid is moved out of an area, a void is created. This void creates a partial vacuum with pulling power and the surrounding substance, e.g. cool air, will be sucked into the void thus, creating a thermal pump system. These concepts are illustrated schematically in FIG. 7 which shows the thermal air pump cooling system 40 mounted to a thermal plate, which may be thermal plate 34 of FIG. 2 or mounting plate/thermal plate 44 of FIG. 5. The lower thermal sink 56 is mounted to the bottom of thermal plate 34. The upper thermal sink 58 is mounted to the top of thermal plate 34.

As illustrated in FIG. 8, there is an opening 42 in thermal plate 34. The area around the thermal plate heats up while the LED lights are in operation. Heat will rise from the lower thermal sink 56 to the upper thermal sink 58 causing a partial vacuum in lower heat sink 56. As illustrated by line 60, cool air will flow from the outside of the thermal sink into the center void of the lower thermal sink 56 then through opening 42 in thermal plate 34 and out openings in upper thermal sink 58. The LEDs are cooled without the use of any fan or other mechanical devices. The thermal air pump component cooling system 40 includes four primary sections/levels.

Figure 10:
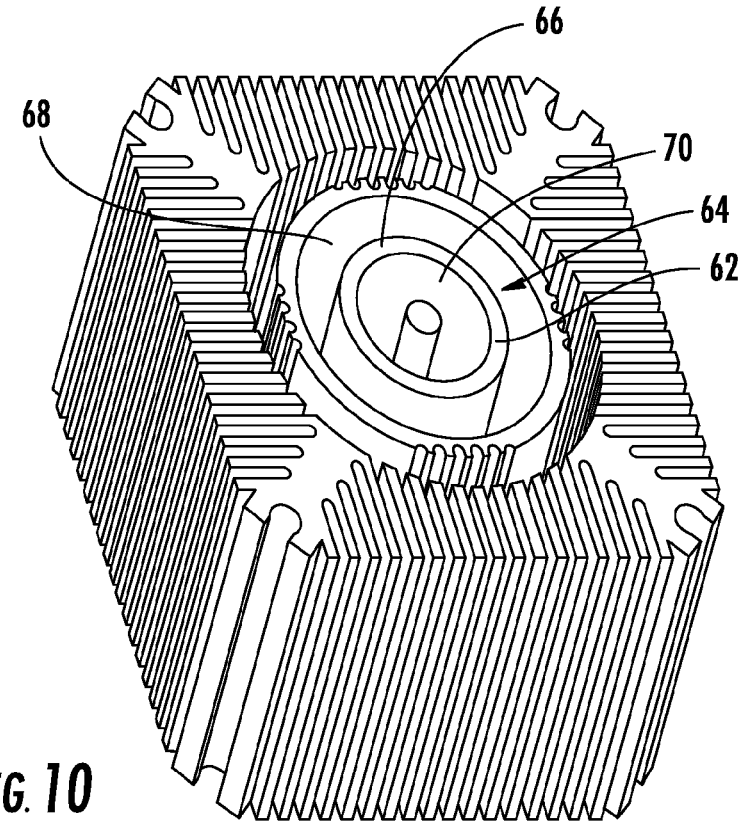
FIG. 10 is a perspective view of the lower cooling section of the thermal heat sink of FIG. 9.

Lower heat sink 56 includes multi-vein thermal transfer activator 62, also referred to as the primer or primary heat sink, and is located below thermal plate 34. As previously indicated, there is an opening 42 in thermal divider plate 34 above the multi-vein thermal transfer activator 62. This opening helps create the desired thermal pump process. As seen in FIG. 10, the center of thermal transfer activator 62 in this embodiment includes a circular thermal transfer guide 64. This circular thermal transfer guide 64 is ring-shaped, however, the void can be substituted with an array of other thermal designs such as, thermal posts vertical fins, and so on as, it has been found to accelerate the thermal cycle and create more surface area for heat transfer.

Figure 9:
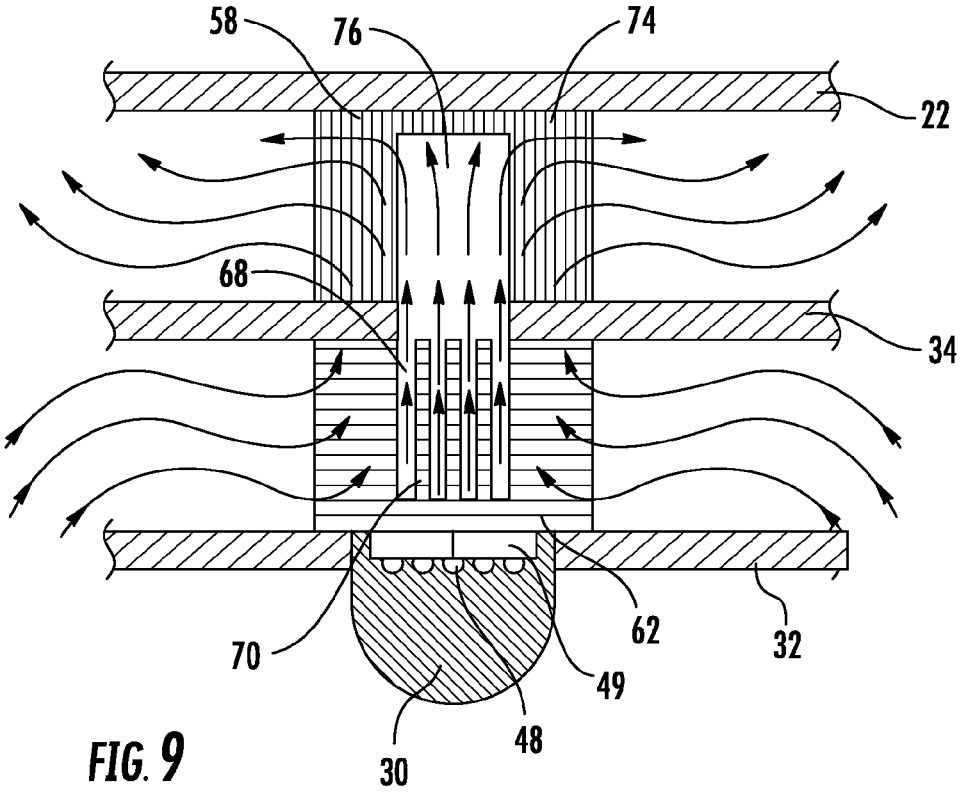
FIG. 9 is a sectional view of a portion of the embodiment of FIG. 8.

As can be seen in FIG. 9, upper thermal sink 58 includes cavity 76 in its center. The thermal air pump acts as a thermal chimney. This thermal chimney helps accelerate the heat upwardly within the system, that is to accelerate heat through the center of thermal divider 34 in a thermal pump affect. The thermal pump affect pulls surrounding air into the lower heat sink void 70 and up toward the upper level 74 of upper thermal sink 58. As heat and adjacent air move from the lower heat sink 56 to the upper level 74 through the hole 42 in the thermal plate 34, a void or partial vacuum is created within the lower section 56. As the heat and air is transferred upward and out, the void in the lower section must be filled. Surrounding cool fresh air is then pulled into this lower section, thus creating a thermal pump cycle and removing more heat. The cycle creates a very efficient cooling system that can be developed in a small package.

While the invention has been described in terms of the above embodiments, those skilled in the art will recognize that the invention can be practiced with modification within the spirit and scope of the appended claims.

The invention claimed is:

1. A lighting fixture adapted to be installed on a ceiling having a predetermined plane comprising:

a light emitting diode (LED) light source supported by the lighting fixture;

a first heat sink portion in proximity to the LED and defining a respective cavity therein that is in communication with one or more vent openings extending through a portion of the first heat sink portion;

a second heat sink portion spaced-apart from above the first heat sink portion and defining a respective cavity therein that is generally aligned with the cavity of the first heat sink portion to form a thermal chimney, the respective cavity of the second heat sink portion defining one or more vent openings extending through a portion of the second heat sink portion; and at least a portion of the lighting fixture protruding below the place of the ceiling supporting said light fixture, whereby cooling fluids pass from outside of the first heat sink portion through the one or more vent openings of the first heat sink portion into the cavity of the first heat sink portion and into the cavity of the second heat sink portion and through the one or more vent openings of the second heat sink portion to outside of the second heat sink portion.

2. A lighting fixture as set forth in claim 1 wherein the at least a portion of the lighting fixture includes a thermal plate that defines the spaced-apart relationship between the first heat sink portion and the second heat sink portion, and wherein the thermal plate includes a hole therein, and wherein said LED light source is positioned beneath said hole.

3. A lighting fixture as set forth in claim 2 wherein the lens plate is connected to said thermal plate by at least one standoff.

4. The lighting fixture as set forth in claim 2, wherein the first heat sink portion is defined between a space between the lens plate holding an LED lens and the thermal plate.

5. The lighting fixture as set forth in claim 4, wherein the second heat sink portion is defined in a space between the thermal plate and a mounting plate.

6. The lighting fixture as set forth in claim 1, wherein the light fixture does not include a fan.

7. The lighting fixture as set forth in claim 1, wherein the first heat sink portion and the second heat sink portion are longitudinally spaced-apart.

8. The lighting fixture as set forth in claim 1, wherein the one or more vent openings of the first heat sink portion are laterally extending openings that extend from an outer periphery of the first heat sink portion to the cavity of the first heat sink portion.

9. The lighting fixture as set forth in claim 1, wherein the first heat sink portion and the second heat sink portion define generally the same outer cross-section.

10. The lighting fixture as set forth in claim 1, wherein the first heat sink portion defines a longitudinally extending thermal guide within the cavity for providing thermal channeling.

11. The lighting fixture as set forth in claim 1, wherein the one or more vent openings of the second heat sink portion are laterally extending openings that extend from an outer periphery of the second heat sink portion to the cavity of the second heat sink portion.

* * * * *